United States Patent [19]

Petersen

[11] 4,015,766

[45] Apr. 5, 1977

[54] PACKAGE OF FIBER MATERIAL OR OTHER RESILIENT MATERIAL FOR RECEIVING FRAGILE ARTICLES, PARTICULARLY EGGS

[75] Inventor: Jørgen Nilaus Petersen, Lyngby, Denmark

[73] Assignee: Aktieselskabet Brodrene Hartmann, Lyngby, Denmark

[22] Filed: Nov. 19, 1975

[21] Appl. No.: 633,259

[30] Foreign Application Priority Data

Jan. 27, 1975 Denmark ..... 251/75

[52] U.S. Cl. ..... 229/2.5 EC; 229/29 M; B65D/25/54

[51] Int. Cl.[2] ..... B65D 1/36

[58] Field of Search ..... 229/2.5 EC, 29 M, 44 EC, 229/45 R

[56] References Cited

UNITED STATES PATENTS

| | | | |
|---|---|---|---|
| 2,655,305 | 10/1953 | Schilling | 229/44 EC |
| 3,145,896 | 8/1964 | Reifers et al. | 229/2.5 EC |
| 3,298,594 | 1/1967 | Makowski et al. | 229/2.5 EC X |
| 3,458,108 | 7/1969 | Howarth et al. | 229/2.5 EC |
| 3,519,189 | 7/1970 | Bambara et al. | 229/2.5 EC |
| 3,570,747 | 3/1971 | McKenna et al. | 229/2.5 EC X |
| 3,672,693 | 6/1972 | Weir | 229/2.5 EC X |
| 3,779,370 | 12/1973 | Snow et al. | 229/2.5 EC X |

*Primary Examiner*—Davis T. Moorhead
*Attorney, Agent, or Firm*—Pennie & Edmonds

[57] ABSTRACT

A package of fiber material or other resilient material for receiving fragile articles, particularly eggs. The package comprises a base member and a top member hinged thereto along one side wall thereof, the flanges of the members engaging each other in the closed state of the package. The top member and the base member have end walls extending transversely of said side wall, the intermediate portion of said end walls being curved inwardly. The flanges of both members at the said curved regions are flared transversely of the main plane of the base member and top member respectively in such a way that the flange of one member in the said region in the closed state of the package forms a recess and the flange of the other member forms a corresponding projection engaging the recess, the end edge of the flared portions being located in the same vertical plane as the end edges of the adjoining flange portions of the said members. The flares may be so spaced from a plane containing the adjoining flange portions of the members that in the closed state of the package a clearance is formed between the flares.

4 Claims, 1 Drawing Figure

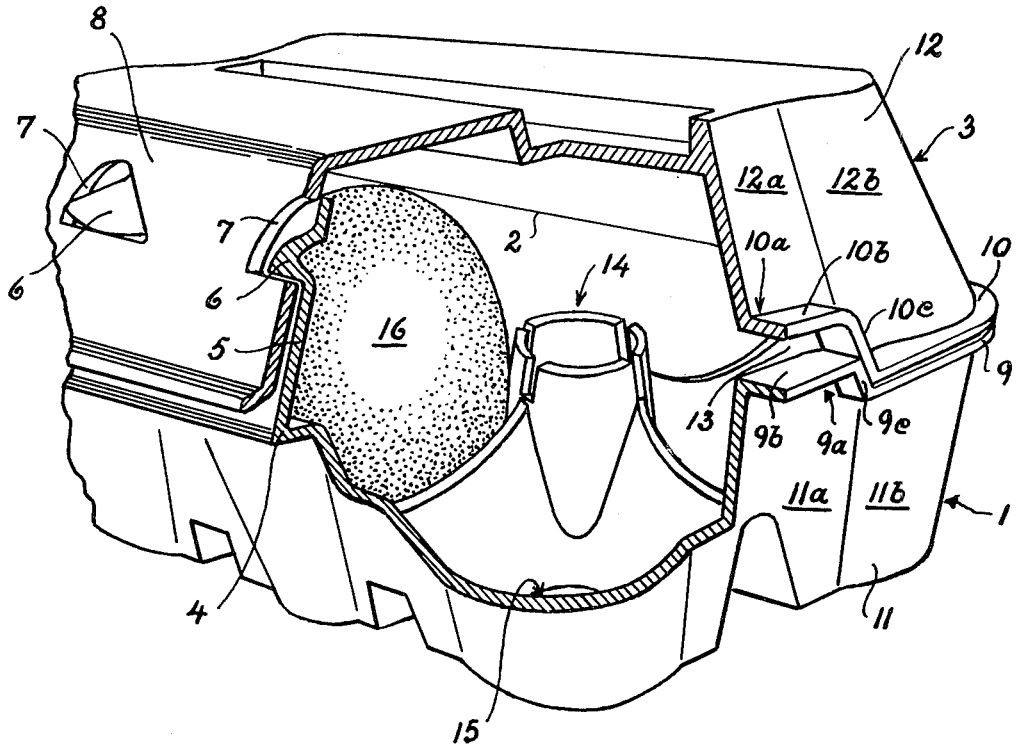
8
12
7
3
12a
12b
7
2
10a
10b
10
14
6
6
10e
5
16
9
13
9b
9a
9e
11a
11b
1
4
11
15

PACKAGE OF FIBER MATERIAL OR OTHER RESILIENT MATERIAL FOR RECEIVING FRAGILE ARTICLES, PARTICULARLY EGGS

This invention relates to a package of fibre material or other resilient material for receiving fragile articles, particularly eggs, comprising a base member and a top member hinged thereto along one side wall thereof, the flanges of the members engaging each other in the closed state of the package, and where the top member and the base member have end walls extending transversely of said side wall, the intermediate portion of said end walls being curved inwardly towards the package.

The object of the invention is to form a package of the aforesaid type in such a way that the top member and the base member in the closed state of the package are secured in a simple and effective manner against mutual displacement in the contact plane of the flanges.

According to the invention this object is achieved by the fact that the flanges of both members at the said curved regions flare transversely of the main plane of the base member and top member respectively in such a way that the flange of one member in the said region in the closed state of the package forms a recess and the flange of the other member forms a corresponding projection engaging the recess, the end edge of the flared portions being located in the same vertical plane as the end edges of the adjoining flange portion of the members.

Thus a connection is provided which is safe against displacement and has particularly large contact surfaces abutting the adjoining ends of the end walls of the base member and the top member. This renders the connection particularly stable and safe, and the connection is obtained by the utilisation of already existing components of the package.

According to the invention the flares may be so spaced from a plane containing the adjoining flange portions of the said members that in the closed state of the package a clearance is formed between the flares thus establishing in a simple manner a vent to the interior of the package.

The invention will now be further explained with reference to the drawing which is an inclined view of a part of a package in the form of an egg carton, some parts of the carton having been removed.

The egg carton illustrated comprises a base member 1, a lid 3 hinged to the member 1 along one of its longitudinal sides by means of a hinge 2, and a locking flap 5 hinged to the opposite longitudinal side of the member 1 by means of a hinge 4. On the drawing the carton is closed. In this state the locking flap 5 is inside the lid 3, and locking projections 6 provided on the locking flap extend through openings 7 formed in the side wall 8 of the lid 3 to releasably lock the lid 3 to the base member 1. The base member 1 has a flange 9, and the top member 3 has a flange 10, the flanges abutting each other when the carton is closed. The end wall 11 of the base member 1 curves inwardly in a section designated 11*a*, and the end wall 12 of the top member 3 curves inwardly in a section designated 12*a*. In other words the adjoining end portions 11*b* and 12*b* of the end walls 11 and 12 extend beyond the sections 11*a* and 12*a*.

At the curved sections 11*a* and 12*a* the flanges 9 and 10 are provided with U-shaped flares 9*a* and 10*a* respectively, flaring transversely of the main plane of the base member 1 and the top member 3. In the embodiment shown the flares are so shaped that the flare 10*a* of the flange 10 constitutes a downwardly open recess and the flare 9*a* of the flange 9 an upstanding corresponding projection engaging the recess. The end edges of the flares 9*a* and 10*a* are located in the same vertical plane as the flange portions of the end sections 11*b* and 12*b*. The invention is not restricted to the embodiment shown as the flares 9*a* and 10*a* may also be oppositely oriented.

In the embodiment shown the flares 9*a* and 10*a* have an elongate central portions 9*b* and 10*b*, and adjoining inclined side portions 9*c* and 10*c* respectively. The side portions 9*c* are lower than the side portions 10*c*, a clearance 13 thus being provided between portions 9*b* and 10*b*, serving to vent the interior of the package when the latter is closed.

By means of upstanding projections 14 in the base member 1 a plurality of pockets 15 for the receipt of eggs 16 is provided.

What I claim is:

1. A package for receiving fragile articles such as eggs which package comprises a base member having two opposite end walls and two opposite side walls, a top member having two opposite end walls and two opposite side walls, said top member being hinged along one of its side walls to one of the side walls of said base member, at least the end walls of said top and bottom member having outwardly extending flanges, the intermediate portion of said end walls being displaced inwardly of said members with respect to the outer end portions of said walls, the flanges of said top and bottom members in the region of said intermediate displaced portions having their flanges offset transversely of the major plane of said members, the offset flange portion of one of said members forming a recess, the offset flange portion of the other of said members forming a projection, said projection in the closed condition of said package being engaged within said recess to maintain alignment of said members laterally, and the terminal edges of said offset portions being located in substantially the same vertical plane as the terminal edges of the adjoining flanges.

2. A package according to claim 1 in which a clearance is provided between said recess and said projection when said package is in the closed condition.

3. A package according to claim 1 in which said offset flange portions have lateral inclined segments which are disposed at an angle with respect to the remainder of said flanges, said inclined segments of said projection in the closed condition of said package being engaged with the inclined segments of said recess.

4. A package according to claim 3 in which said inclined segments are at an angle other than 90° with respect to the remainder of said flanges.

* * * * *